US011452411B2

(12) United States Patent
Lee et al.

(10) Patent No.: US 11,452,411 B2
(45) Date of Patent: Sep. 27, 2022

(54) ROBOT CLEANER

(71) Applicant: SAMSUNG ELECTRONICS CO., LTD., Suwon-si (KR)

(72) Inventors: Byoung-In Lee, Suwon-si (KR); Byung-Chan Kim, Yongin-si (KR); Woo-Ram Oh, Suwon-si (KR); Won-Kyu Lim, Suwon-si (KR); Kyung-Han Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 375 days.

(21) Appl. No.: 16/076,838

(22) PCT Filed: Jan. 10, 2017

(86) PCT No.: PCT/KR2017/000310
§ 371 (c)(1),
(2) Date: Aug. 9, 2018

(87) PCT Pub. No.: WO2017/142202
PCT Pub. Date: Aug. 24, 2017

(65) Prior Publication Data

US 2019/0045991 A1 Feb. 14, 2019

(30) Foreign Application Priority Data

Feb. 19, 2016 (KR) ..... 10-2016-0019770

(51) Int. Cl.
*A47L 9/22* (2006.01)
*A47L 9/00* (2006.01)
(Continued)

(52) U.S. Cl.
CPC ..... *A47L 9/0081* (2013.01); *A47L 9/00* (2013.01); *A47L 9/14* (2013.01); *A47L 9/1666* (2013.01); *A47L 9/1683* (2013.01); *A47L 9/22* (2013.01)

(58) Field of Classification Search
CPC ..... A47L 9/0081; A47L 9/22; A47L 2201/00
See application file for complete search history.

(56) References Cited

U.S. PATENT DOCUMENTS 5,293,664 A * 3/1994 Lim ..... A47L 9/22 15/326
8,667,638 B2 3/2014 Kim et al.
(Continued)

FOREIGN PATENT DOCUMENTS

CN 101191499 A * 6/2008
CN 101191499 A 6/2008
(Continued)

OTHER PUBLICATIONS

Extended European Search Report dated Mar. 14, 2019 in corresponding European Patent Application No. 17753364.3.
(Continued)

*Primary Examiner* — Bryan R Muller
(74) *Attorney, Agent, or Firm* — Staas & Halsey LLP

(57) ABSTRACT

A robot cleaner motor assembly including: a fan motor and a fan motor casing including an exhaust passage for guiding, to an exhaust port, air discharged from the fan motor, wherein the exhaust passage includes: a first exhaust passage guiding the air such that the air, discharged from a discharge port of the fan motor, moves to an upper or lower side of the fan motor; a second exhaust passage guiding, to a front end of the fan motor, the air discharged from the first exhaust passage; a third exhaust passage guiding the air such that the air, discharged from the second exhaust passage, moves to the lower or upper side of the fan motor along left and right
(Continued)

sides of the fan motor; and a fourth exhaust passage guiding, to an exhaust port, the air having moved along the left and right sides of the third exhaust passage.

14 Claims, 16 Drawing Sheets

(51) Int. Cl.
*A47L 9/14* (2006.01)
*A47L 9/16* (2006.01)

(56) References Cited

U.S. PATENT DOCUMENTS

| | | | | |
|---|---|---|---|---|
| 9,693,662 | B2 * | 7/2017 | Tadina | A47L 9/22 |
| 9,750,381 | B2 | 9/2017 | Kim et al. | |
| 2013/0312215 | A1 | 11/2013 | Kim et al. | |
| 2014/0182453 | A1 | 7/2014 | Yun | |
| 2015/0128375 | A1 | 5/2015 | Tadina et al. | |
| 2016/0037984 | A1 * | 2/2016 | Park | F04D 29/626 15/326 |

FOREIGN PATENT DOCUMENTS

| | | | |
|---|---|---|---|
| CN | 201469182 U | | 5/2010 |
| CN | 201727457 U | | 2/2011 |
| CN | 201727457 U | * | 2/2011 |
| CN | 204365046 U | | 6/2015 |
| CN | 204581157 U | | 8/2015 |
| EP | 1 721 557 | | 11/2006 |
| EP | 2 436 291 | | 4/2012 |
| EP | 2 870 905 | | 5/2015 |
| GB | 2 344 778 | | 6/2000 |
| JP | 10-201678 | | 8/1998 |
| KR | 10-0447410 | | 9/2004 |
| KR | 10-2006-0122521 | | 11/2006 |
| KR | 10-2010-0117817 | | 11/2010 |
| KR | 10-1320775 | | 10/2013 |
| KR | 10-1461985 | | 11/2014 |
| KR | 10-1476206 | | 12/2014 |
| KR | 10-2015-0125224 | | 11/2015 |
| KR | 20150125224 A | * | 11/2015 |
| WO | WO 2004/004535 A1 | | 1/2004 |

OTHER PUBLICATIONS

International Search Report, PCT/ISA/210, dated Apr. 27, 2017, in corresponding International Patent Application No. PCT/KR2017/000310.

Written Opinion, PCT/ISA/237, dated Apr. 27, 2017, in corresponding International Patent Application No. PCT/KR2017/000310.

"POWERbot user manual", Samsung, SR20H9050U, SR20H9030U, Jun. 10, 2016.

Chinese Office Action dated Jun. 2, 2020, in corresponding Chinese Patent Application No. 201780010442.6.

Chinese Office Action dated Jan. 26, 2021, in corresponding Chinese Patent Application No. 201780010442.6.

Office Action issued in Chinese Patent Application No. 201780010442.6 dated Jul. 9, 2021 (18 pages including translation).

Korean Office Action for Korean Patent Application No. 10-2016-0019770 dated Nov. 30, 2021.

* cited by examiner

ROBOT CLEANER

This application is a U.S. National Stage Application, which claims the benefit under 35 U.S.C. § 371 of International Patent Application No. PCT/KR2017/000310 filed on Jan. 10, 2017, which claims the foreign priority benefit under 35 U.S.C. § 119 of Korean Patent Application No. 10-2016-0019770, filed Feb. 19, 2016, the contents of which are incorporated herein by reference.

TECHNICAL FIELD

The present disclosure relates to a robot cleaner, and more particularly, to a robot cleaner comprising a motor assembly which generates an absorptive power capable of absorbing filth and dust.

DESCRIPTION OF RELATED ART

In general, a robot cleaner carries out cleaning by autonomously moving on a surface to be cleaned and absorbing filth and dust from the surface to be cleaned.

Accordingly, a robot cleaner includes a fan motor to generate an absorptive power capable of absorbing filth and dust. By the absorptive power generated by the fan motor, the air including filth and dust is absorbed into the robot cleaner. A dust collector is installed in the front of the fan motor and thus, the filth and dust included in the absorbed air is separated by the dust collector and then, only clean air is discharged outside the robot cleaner via the fan motor.

An exhaust air hole is provided in the main body of the robot cleaner in which the fan motor is installed and thus, the air discharged from the outlet of the fan motor is discharged outside the robot cleaner.

However, the exhaust air hole of the main body of the robot cleaner is formed to be adjacent to the outlet of the fan motor and thus, when the fan motor is operated, the noise generated by the fan motor is directly transferred outside. Accordingly, there is a problem that the robot cleaner generates a loud noise when cleaning is carried out.

To reduce such noise, a sound absorbing member may be installed between the exhaust hole of the main body of the robot cleaner and the outlet of the fan motor. However, there is a problem that the noise of the robot cleaner cannot be sufficiently reduced by such a sound absorbing member alone.

Accordingly, there is a demand for development of a robot cleaner which is capable of effectively reducing noise generated by the fan motor while cleaning is carried out.

DETAILED DESCRIPTION

The present disclosure is invented in consideration of the problems mentioned above, and relates to a robot cleaner which is capable of reducing noise of the fan motor by forming a long exhaust flow path through which the air discharged from the fan motor passes.

According to an aspect of the present disclosure, a robot cleaner may include a motor assembly. The motor assembly may include a fan motor for suctioning air through a fan intake port provided at the front surface thereof and discharging the air through a discharge port formed at the rear surface thereof, and a fan motor casing encasing the fan motor, and including an exhaust passage for guiding, to an exhaust port, the air discharged from the fan motor. The exhaust passage of the fan motor casing may include a first exhaust passage formed at the rear surface of the fan motor, and guiding the air such that the air, discharged from the discharge port of the fan motor, moves to an upper or lower side of the fan motor, a second exhaust passage formed at the upper or lower side of the fan motor, and guiding, to a front end of the fan motor, the air discharged from the first exhaust passage, a third exhaust passage provided at a left and right sides of the fan motor, and guiding the air such that the air, discharged from the second exhaust passage, moves to the lower or upper side of the fan motor along the left and right sides of the fan motor, and a fourth exhaust passage provided at the lower or upper side of the fan motor, and guiding, to the exhaust port, the air having moved along the left and right sides of the third exhaust passage.

The fan motor casing may include a case body in which a receiving unit capable of receiving the fan motor is provided, a pair of vertical walls formed on left and right sides of the fan motor in the case body, and when the fan motor is received in the case body, dividing an inner part of the case body into a front chamber and a rear chamber, and a barrier provided on an upper side of a rear end part of the fan motor and covering an upper side of the rear chamber.

The robot cleaner may further include a cleaner body in which a motor receiving unit in which the motor assembly is received is provided. The cleaner body may include an exhaust cover covering a discharge port of the motor assembly.

According to another aspect of the present disclosure, a robot cleaner may include a motor assembly. The motor assembly may include a fan motor for suctioning air through a fan intake port provided at the front surface thereof and discharging the air through a discharge port formed at the rear surface thereof, and a fan motor casing encasing the fan motor, and including an exhaust passage for guiding, to an exhaust port, the air discharged from the fan motor. The fan motor casing may include a case body in which a receiving unit capable of receiving the fan motor is provided, an air suctioning port formed at the front surface of the case body, a pair of vertical walls extended from left and right sides of the case body toward the fan motor, and when the fan motor is received in the case body, dividing an inner part of the case body into a front chamber and a rear chamber, and a barrier provided at the upper side of a rear end of the fan motor and covering an upper part of the rear chamber.

The exhaust passage may be formed by an outer side of the fan motor and the fan motor casing.

The exhaust passage may be formed by a rear surface of the case body, a rear surface of the fan motor, and a barrier of the case body. The exhaust passage may include a first exhaust passage guiding air discharged from a discharge port of the fan motor toward a lower direction of the fan motor, a second exhaust passage formed by a lower surface of the case body and a lower surface of the fan motor and guiding the air discharged from the first exhaust passage to a front end of the front motor; a third exhaust passage formed by left and right sides of the case body and left and right sides of the fan motor and guiding the air discharged from the second exhaust passage to an upper side of the fan motor along the left and right sides of the fan motor; and a fourth exhaust passage formed by an upper surface of the case body, an upper surface of the fan motor and a barrier of the case body and guiding the air having moved along left and right sides of the third exhaust passage to the exhaust port.

PREFERRED EMBODIMENTS FOR CARRYING OUT THE INVENTION

Figure 1:
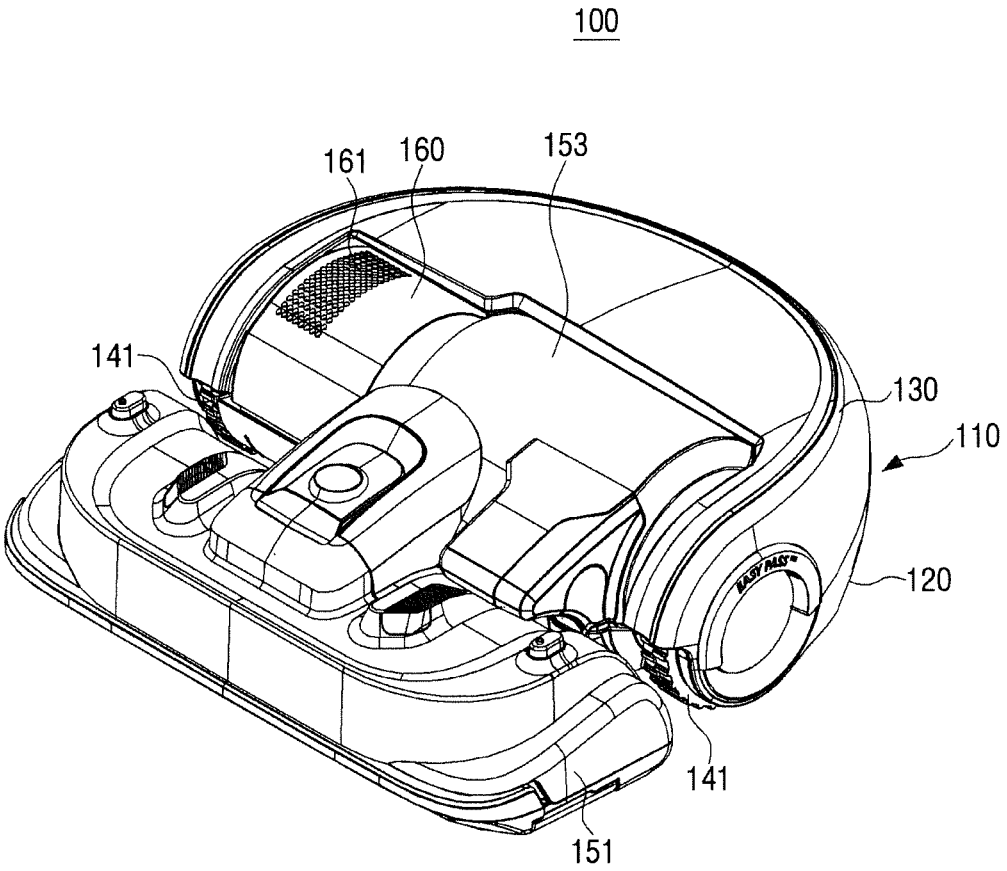
FIG. 1 is a perspective view illustrating a robot cleaner, according to an example embodiment of the present disclosure.

Hereinafter, the example embodiments of a robot cleaner are described in greater detail with reference to the accompanying drawings.

In the following description, same drawing reference numerals are used for the same elements even in different drawings. In the following description, well-known functions or constructions are not described in detail since they would obscure the invention in unnecessary detail. Further, dimensions of various elements in the accompanying drawings may be arbitrarily increased or decreased for assisting in a comprehensive understanding.

Figure 2:
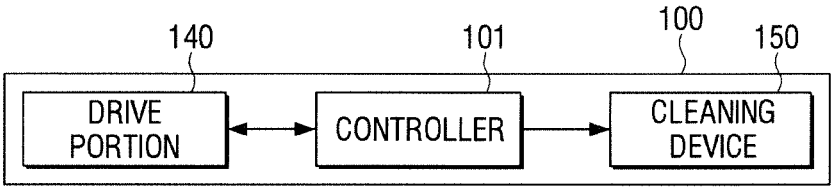
FIG. 2 is a functional block diagram illustrating a robot cleaner, according to an example embodiment of the present disclosure.

FIG. 1 is a block diagram of a robot cleaner according to an example embodiment of the present disclosure and FIG. 2 is a functional block diagram of a robot cleaner according to an example embodiment of the present disclosure.

Referring to FIGS. 1 and 2, a robot cleaner 100 according to an example embodiment of the present disclosure may include a main body 110, a controller 101, a drive portion 140, and a cleaning device 150.

The main body 110 forms the exterior of the robot cleaner 100, and the controller 101, the drive portion 140, and the cleaning device 150 are installed in the main body 110. In addition, in the main body 110, a location sensing unit (not illustrated) capable of sensing a current location of the robot cleaner 100, an obstacle sensing unit (not illustrated) capable of sensing peripheral obstacles, the controller 101, the drive portion 140, and a power supply unit (not illustrated) capable of supplying power to the location sensing unit (not illustrated), the obstacle sensing unit (not illustrated), the cleaning device 150, and the like.

The driver 140 controls the robot cleaner 100 to move on a surface to be cleaned, and includes a pair of wheels 141 installed on the left and right sides of the main body 110. The pair of wheels 141 are configured to rotate by two driving units. Accordingly, when the controller 101 controls the driving unit and rotates the pair of wheels 141, the robot cleaner 100 may be moved on the surface to be cleaned.

The cleaning device 151 is to absorb filth and dust from the surface to be cleaned, and includes a suction nozzle 151 installed at the front end of the main body 110 and a dust collecting device 153 and motor assembly 1 installed at the upper side of the main body 110.

An intake port (not illustrated) may be formed at a bottom surface of the suction nozzle 151, and a brush (not illustrated) for collecting filth may be rotatably installed at the intake port. The suction nozzle 151 is interconnected to the dust collecting device 153, and the dust collecting device 153 is connected to the motor assembly 1. The motor assembly 1 generates a suction force, and the dust collecting device 153 is formed to discharge only air cleaned by separating filth and dust from the sucked air. The dust collecting device 153 may include a dust filter bag, a cyclone dust collecting device, and the like. In the present example embodiment, a cyclone dust collecting device is used for the dust collecting device 153.

When the motor assembly 1 is operated and a suction force is generated, a suction force is applied to an intake port of the suction nozzle 151 via the dust collecting device 153. Then, the air including filth and dust is sucked into the dust collecting device 153 via the intake port of the suction nozzle 151 by the suction force. The dust collecting device 153 separates filth and dust from the sucked air and discharges the cleaned air to the motor assembly 1. The sucked air passes through the motor assembly 1 and is discharged outside the robot cleaner 100. The structure of the motor assembly 1 will be described in detail below with reference to the accompanying drawings.

The controller 101 controls the drive portion 140 and moves the robot cleaner 100, and controls the motor assembly 1 of the cleaning device 151 and generates a suction force and absorbs filth and dust from the surface to be cleaned to clean.

The structure of the robot cleaner 100 as described above is the same as or similar to the conventional robot cleaner; therefore, a detailed description thereof is omitted.

Hereinafter, an exhaust cover of a robot cleaner according to an example embodiment of the present disclosure will be described with reference to FIGS. 3-7.

Figure 3:
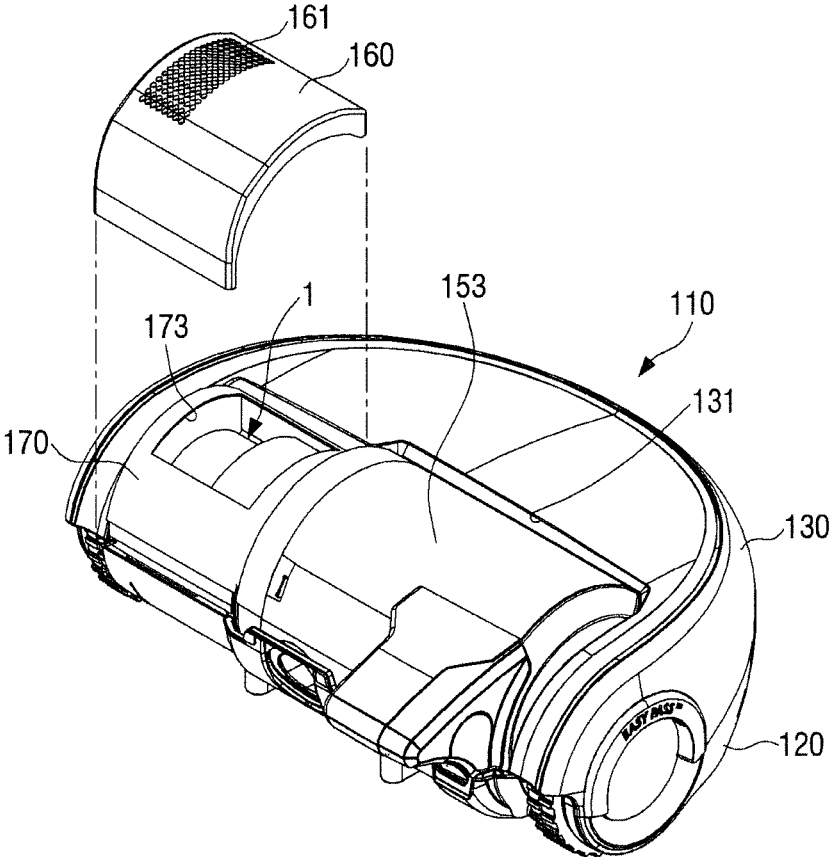
FIG. 3 is a perspective view illustrating a state in which an exhaust cover is separated from the main body of the robot cleaner, according to an example embodiment of the present disclosure.
Figure 4:
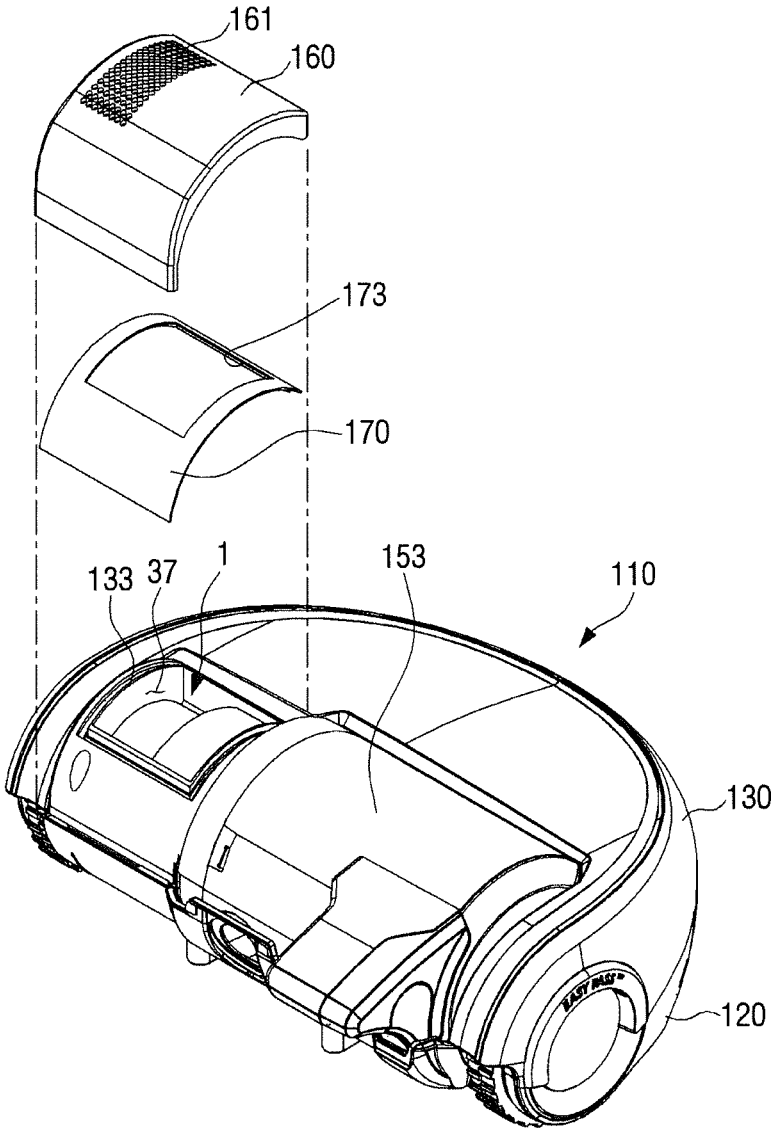
FIG. 4 is a perspective view illustrating a state in which a sealing member is separated from the main body of the robot cleaner of FIG. 3, according to an example embodiment of the present disclosure.
Figure 5:
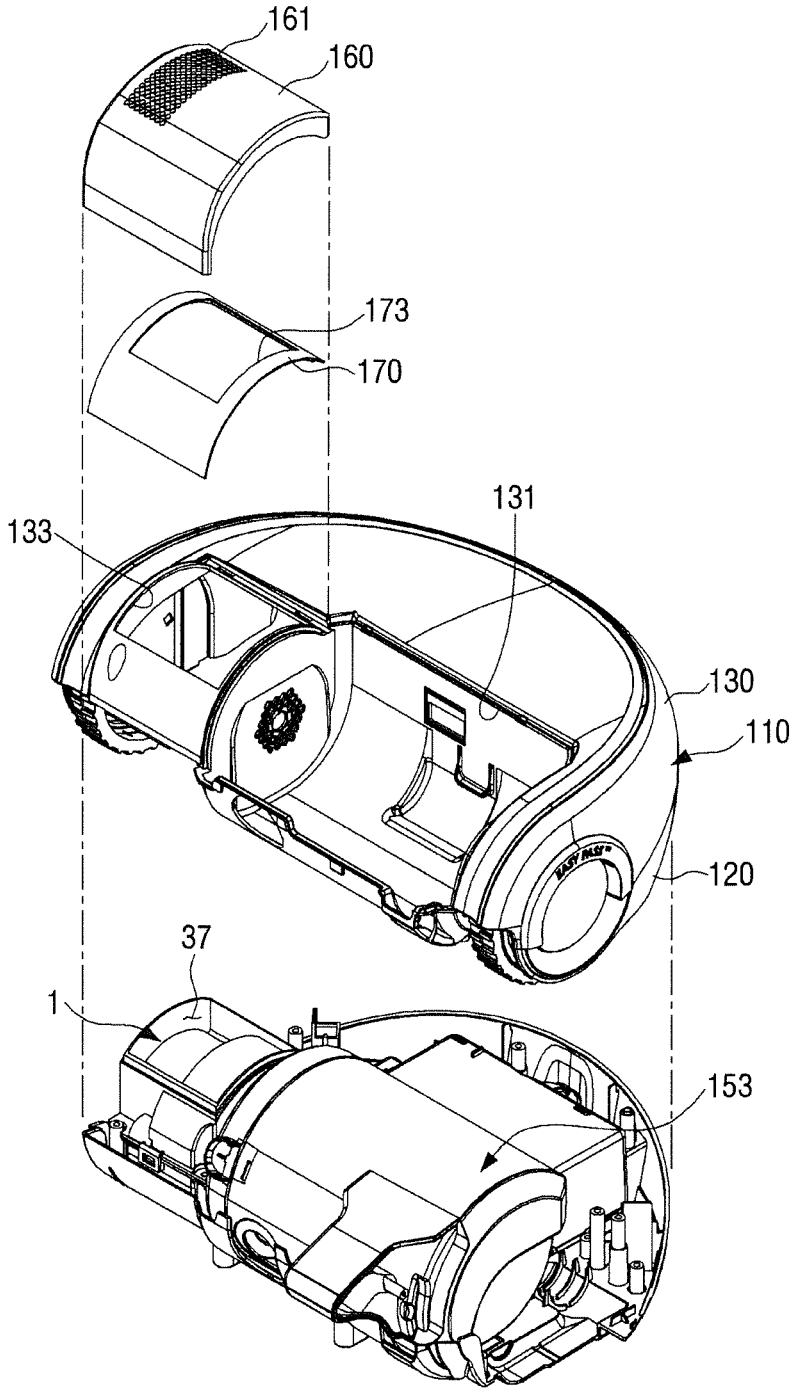
FIG. 5 is a perspective view illustrating a state in which an upper cover is separated from the main body of the robot cleaner of FIG. 3, according to an example embodiment of the present disclosure.
Figure 6:
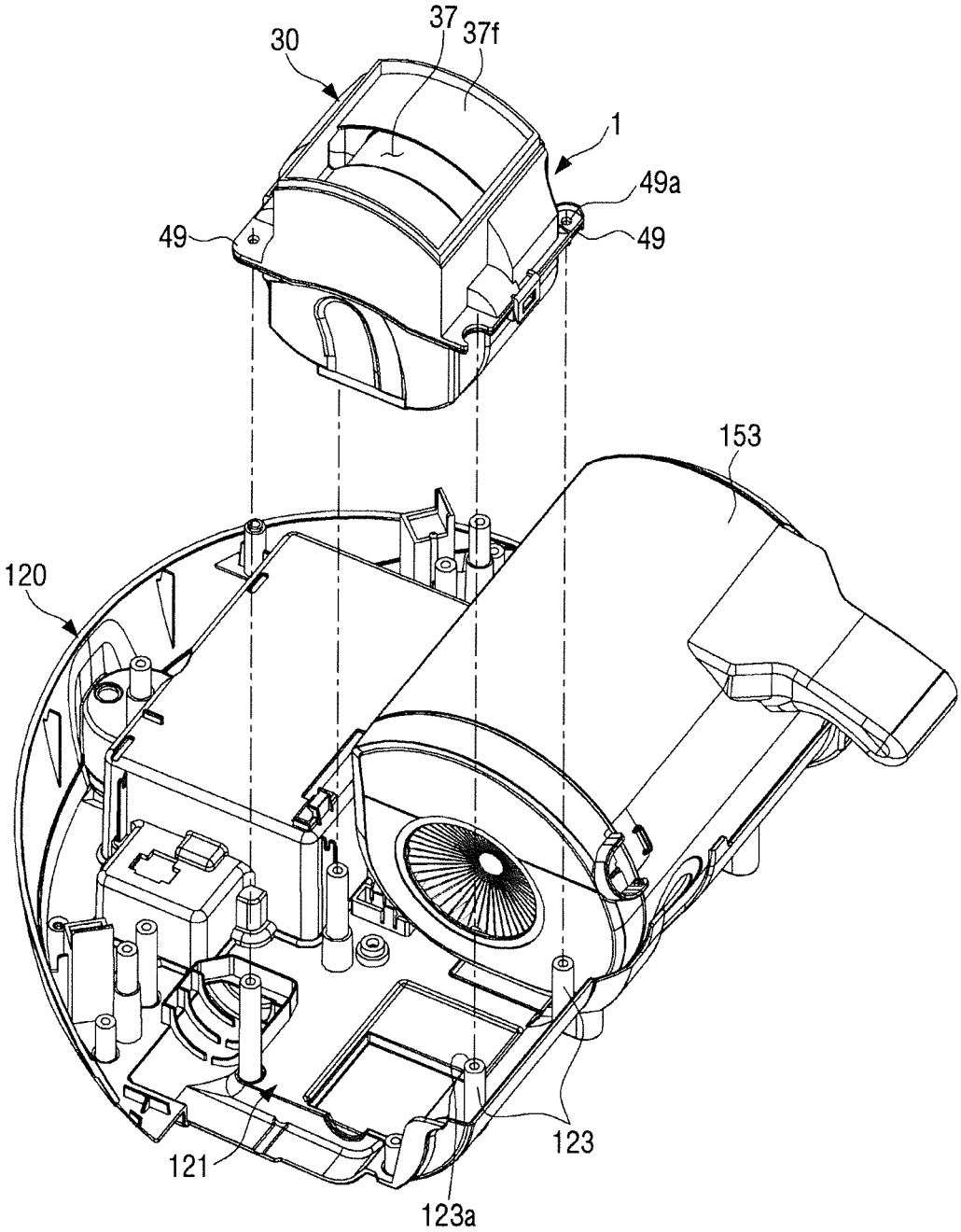
FIG. 6 is a perspective view illustrating a motor receiving unit provided in a base of the robot cleaner, according to an example embodiment of the present disclosure.
Figure 7:
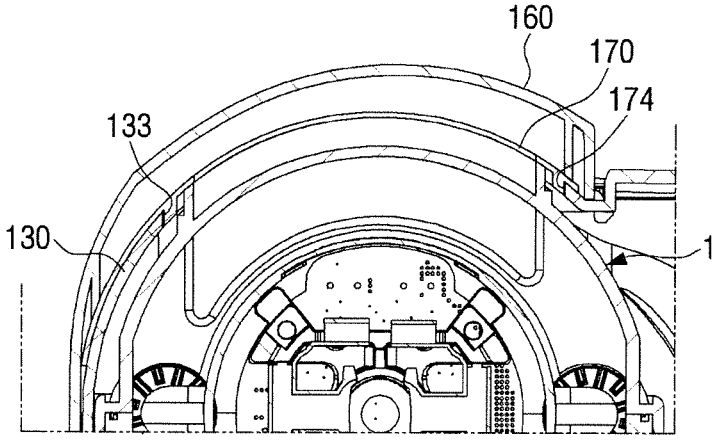
FIG. 7 is a cross-sectional view illustrating a relationship between an exhaust cover of the robot cleaner and a motor assembly, according to an example embodiment of the present disclosure.

FIG. 3 is a perspective view illustrating a state in which an exhaust cover is separated from the main body of the robot cleaner, according to an example embodiment of the present disclosure. FIG. 4 is a perspective view illustrating a state in which a sealing member is separated from the main body of the robot cleaner of FIG. 3. FIG. 5 is a perspective view illustrating a state in which an upper cover is separated from the main body of the robot cleaner of FIG. 3. FIG. 6 is a perspective view illustrating a motor receiving unit provided in a base of the robot cleaner, according to an example embodiment. FIG. 7 is a partial cross-sectional view illustrating a relationship between an exhaust cover and a motor assembly of the robot cleaner, according to an example embodiment.

Referring to FIGS. 3-5, a main body 110 of a robot cleaner 100 according to an example embodiment includes a base 120 and an upper cover 130.

In the base 120, a controller 101, a drive portion 140, a location sensing unit (not illustrated), an obstacle sensing unit (not illustrated), a power supply unit (not illustrated), and the like. In addition, in the base 120, a motor assembly 1 of the cleaning device 150 is installed. To this end, in the base 120, a motor receiving unit 121 in which the motor assembly 1 is received and fixed is provided. An example of the motor receiving unit 121 is illustrated in FIG. 6. To show that the dust collecting device 153 and the motor assembly 1 are connected to each other, FIGS. 5 and 6 illustrate a state in which the dust collecting device 153 is installed in the base 120. However, the dust collecting device 153 is, as illustrated in FIGS. 1-4, removably installed in the dust collecting device receiving unit 131 of the upper cover 130 of the main body 110.

Referring to FIG. 6, the motor receiving unit 121 includes a plurality of protrusions 123 which are protruded upward from the base 120. The plurality of protrusions 123 may be implemented as four protrusions 123 so that four places of the motor assembly 1 may be supported. Each protrusion 123 is roughly formed in the shape of a pillar, and a female screw 123*a* to which a nut and a bolt may be coupled is formed at the upper end of the protrusion 123. In the motor assembly 1, four fixing parts which are fixed to the four protrusions 123 may be provided. A height of the protrusion 123 may be determined such that a bottom surface of the motor assembly 1 does not come into contact with the base 121 when the motor assembly 1 is installed.

The upper cover 130 covers an upper portion of the base 120 such that the controller 101, the drive portion 140, the location sensing unit (not illustrated), the obstacle sensing unit (not illustrated), the power supply unit (not illustrated), and the like are not exposed outside. In the upper cover 130, a dust collecting device mounting unit 131 on which the cyclone dust collecting device 153 is removably mounted is provided. As illustrated in FIG. 5, a first exhaust port 133 corresponding to an exhaust port of the motor assembly 1 is provided in a portion of the upper cover 130 covering an upper portion of the motor assembly 1 installed in the base 120 toward one side of the dust collecting device mounting unit 131. The exhaust port 133 is formed to be approximately rectangular to correspond to an upper surface of the motor assembly 1.

In the upper side of the first exhaust port 133 of the upper cover 130, an exhaust cover 160 is installed to cover the first exhaust port 133. Referring to FIGS. 3 and 7, a sealing member 170 is installed between the upper cover 130 and the exhaust cover 160 along a circumference of the first exhaust port 133 in order to block the vibration of the motor assembly 1 from being transferred to the exhaust cover 160 via the upper cover 130. In addition, the sealing member 170 prevents air from leaking between the upper cover 130 and the exhaust cover 160. In the sealing member 170, a second exhaust port 173 formed to correspond to the first exhaust port 133 is provided. Along a circumference of the second exhaust port 173, at the bottom surface of the sealing member 170, a protrusion 174 which is inserted into the first exhaust port 133 of the upper cover 130 may be formed.

As another example, the sealing member 170 may integrally form a dust filter in the second exhaust port 173. For the dust filter, a high-performance filter capable of filtering a fine dust included in the air discharged from the motor assembly 1 may be used.

The exhaust cover 160 is installed at the upper cover 130 to cover the main body 110 of the robot cleaner 100, that is, the first exhaust port 133 of the upper cover 130. When the exhaust cover 160 is installed at the main body 110 of the robot cleaner 100, that is, the upper cover 130, the exhaust cover 1600 would cover an upper side of the exhaust port of the motor assembly 1. In the exhaust cover 160, a plurality of holes 161 are formed at a position corresponding to an exhaust port of the motor assembly 1. Accordingly, the air discharged from the exhaust port of the motor assembly 1 is discharged outside the robot cleaner 100 via the plurality of holes 161 of the exhaust cover 160 covering the first exhaust port 133 of the upper cover 130.

The motor assembly 1 used in the robot cleaner 100 according to an example embodiment will be described in detail below with reference to the accompanying FIGS. 8-10.

Figure 8:
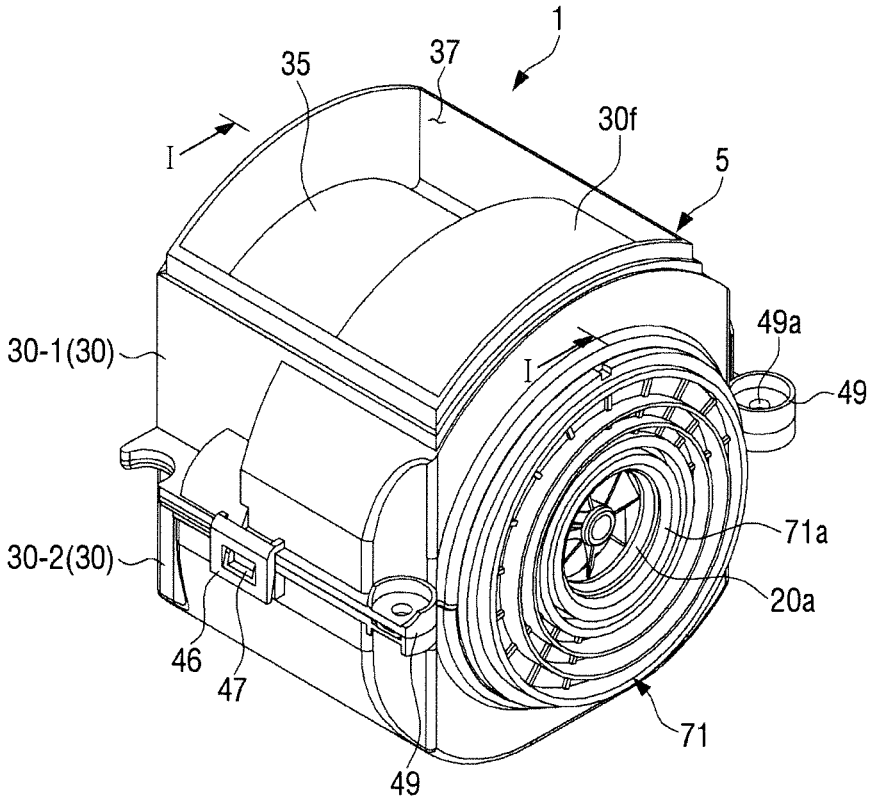
FIG. 8 is a perspective view illustrating a motor assembly used in the robot cleaner, according to an example embodiment of the present disclosure.

FIG. 8 is a perspective view illustrating a motor assembly used in the robot cleaner, according to an example embodiment of the present disclosure. FIG. 9 is a separated perspective view of a motor assembly of FIG. 8. FIG. 10 is a cross-sectional view in which the motor assembly of FIG. 8 is cut along the line I-I.

Figure 9:
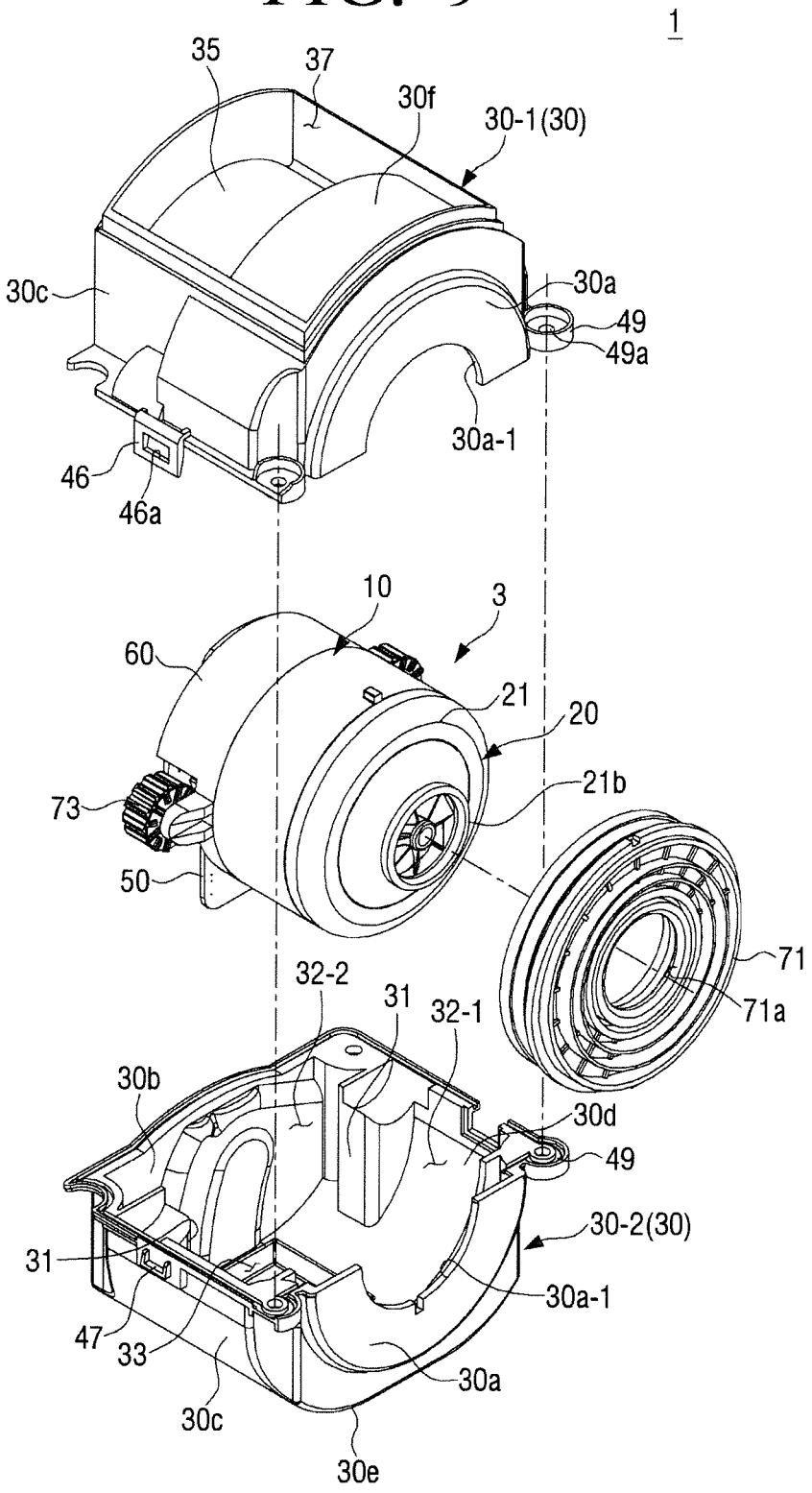
FIG. 9 is a separated perspective view illustrating the motor assembly of FIG. 8.
Figure 10:
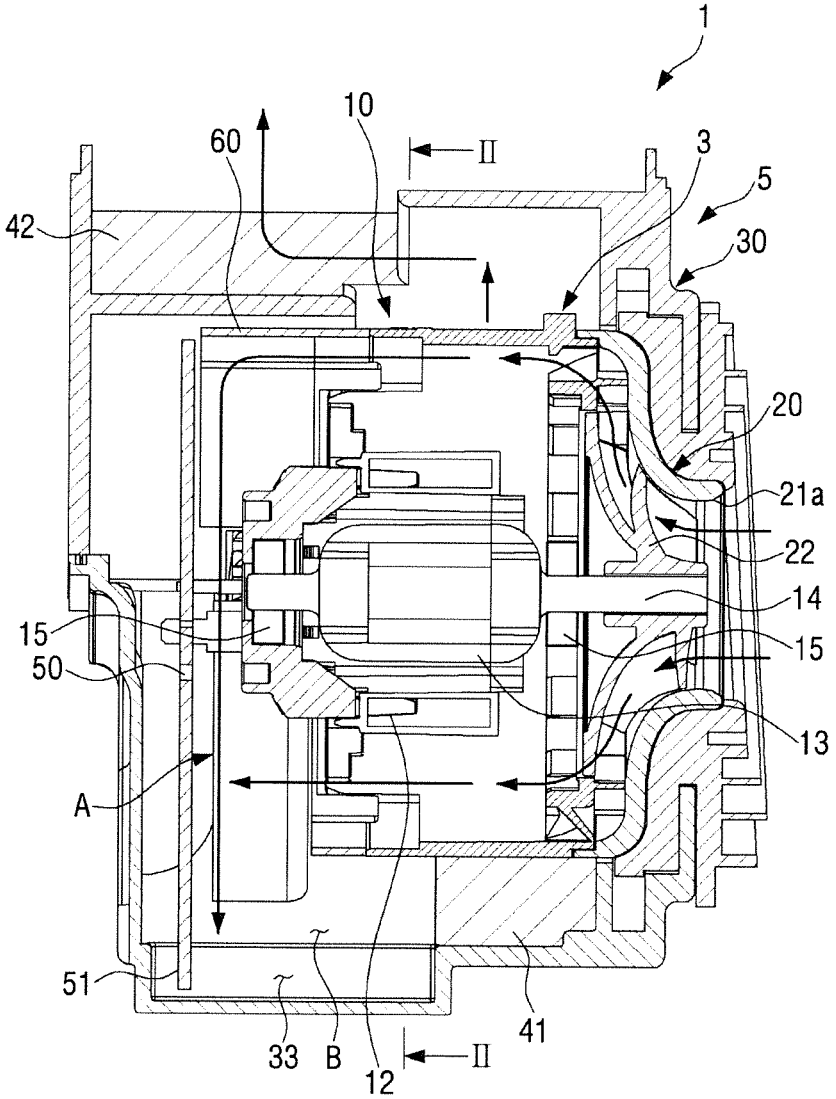
FIG. 10 is a cross-sectional view in which the motor assembly of FIG. 8 is cut along the line I-I.

Referring to FIGS. 8-10, the motor assembly 1 according to an example embodiment includes a fan motor 3 and a fan motor casing 5.

The fan motor 3 is formed to generate a suction force to absorb outside air into the dust collecting device 153. The fan motor 3 is configured to absorb air into an intake port 21*a* formed on the front side and to discharge absorbed air to an outlet 17 formed on the rear side.

The fan motor casing 5 surrounds the cap motor 3 and includes an exhaust port 37 which discharges air discharged from a rear end of the fan motor 3. In the fan motor casing 5, an exhaust passage guiding air discharged from a rear end of the fan motor 3 to the exhaust port 37 is provided. The exhaust passage is formed such that a passage through which air discharged from the fan motor 3 passes is formed as longest as possible. When an exhaust passage is formed long, the kinetic energy of air discharged from the fan motor 3 is reduced and thus, the noise is reduced.

An exhaust passage of the motor assembly 1 formed by the fan motor 3 and the fan motor casing 5 will be described in detail below with reference to FIGS. 11 and 12.

Figure 11:
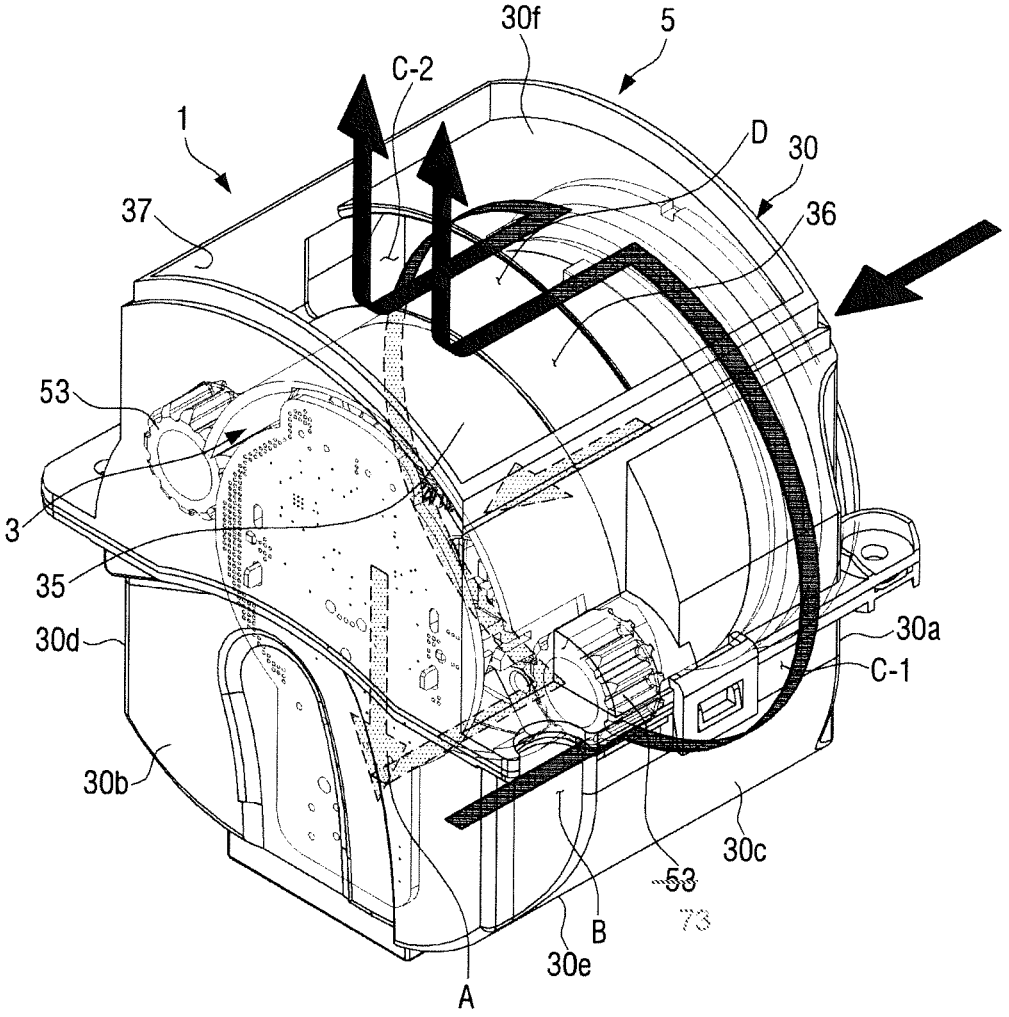
FIG. 11 is a perspective view illustrating an exhaust flow path through which the air intake port in the motor assembly is discharged, according to an example embodiment of the present disclosure.

FIG. 11 is a perspective view illustrating an exhaust passage from which the air intake port from the motor assembly is discharged, according to an example embodiment. FIG. 12 is a rear perspective view illustrating an exhaust passage of a motor assembly, according to an example embodiment. In FIGS. 11 and 12, the fan motor casing 5 is illustrated as being transparent so that the fan motor 3 therein is visible. In addition, the bold arrows of FIGS. 11 and 12 indicate an air flow passing through the exhaust passage.

Figure 12:
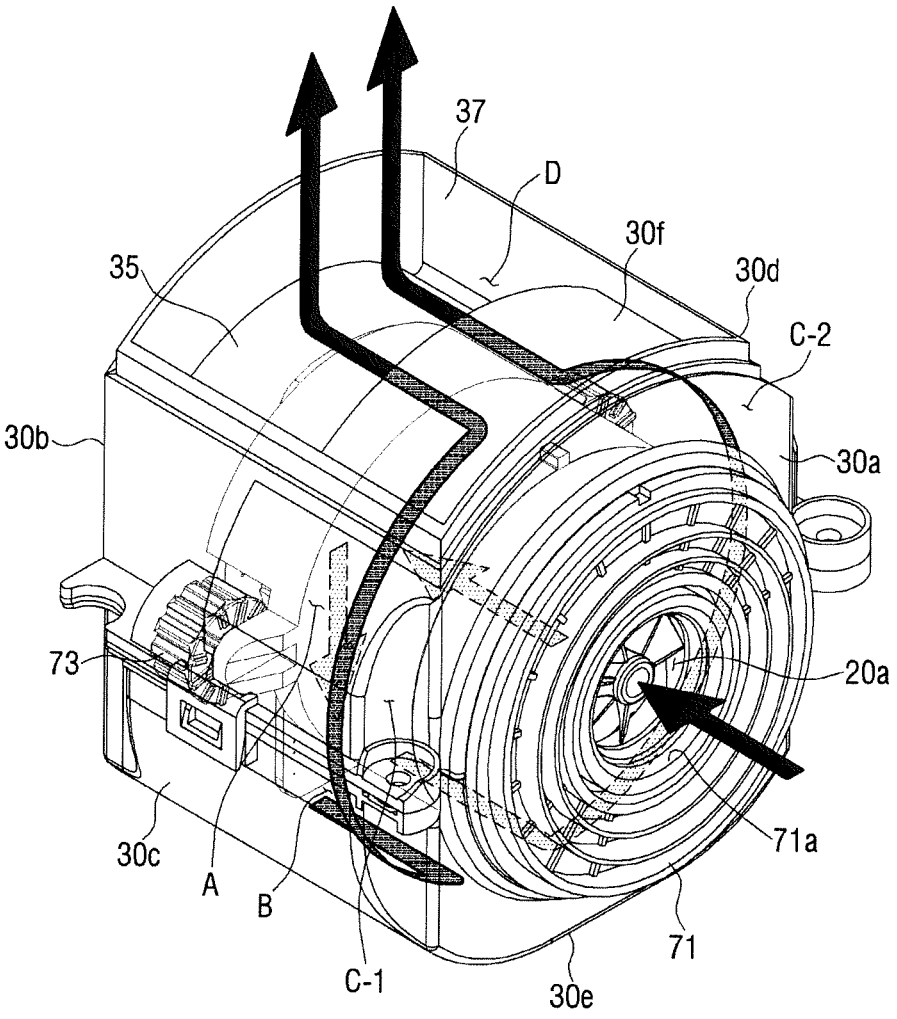
FIG. 12 is a rear perspective view illustrating an exhaust flow path of the motor assembly, according to an example embodiment of the present disclosure.

Referring to FIGS. 11 and 12, the exhaust passage of the motor assembly 1 includes four exhaust passages formed along a circumference of the fan motor 3, that is, a first exhaust passage A, a second exhaust passage B, a third exhaust passage C-1 and C-2, and a fourth exhaust passage D.

The first exhaust passage A is formed at the rear end of the fan motor 3, and guides air discharged from the outlet 17 of the fan motor 3 to an axial direction of the fan motor 3 to move toward a lower direction of the fan motor 3. In other words, the first exhaust passage A is formed to change a moving direction of the discharged air so that the air discharged from the fan motor 3 in the axial direction is moved to a direction perpendicular to the axial direction of the fan motor 3.

The second exhaust passage B is formed at the lower side of the fan motor 3 to be interconnected to the first exhaust passage A, and guides the air discharged from the first exhaust passage A to move in parallel to the axial direction of the fan motor 3. In an example embodiment illustrated in FIGS. 11 and 12, the second exhaust passage B is formed such that the air is moved from the rear end of the fan motor 3 to the front end of the fan motor 3 along the bottom surface of the fan motor 3.

The third exhaust passage C-1 and C-2 is provided on the left and right sides of the fan motor 3, and is interconnected to the second exhaust passage B. The third exhaust passage C-1 and C-2 is formed such that the air discharged from the second exhaust passage B is moved from the lower side of the fan motor 3 to the upper side of the fan motor 3 along the left and right sides of the outer sides of the fan motor 3. Accordingly, the air which is moved along the second exhaust passage B is diverged into two air flows by the third exhaust passage C-1 and C-2. In this regard, a first soundproofing member 41 may be installed at a portion of the second exhaust passage B which is connected to two passages of the third exhaust passage C-1 and C-2, that is, the left passage C-1 and the right passage C-2. The first soundproofing member 41 allows the air of the second exhaust passage B to be equally divided and be intake port to the third exhaust passage C-1 and C-2, and reduces noise of the air passing through the second exhaust passage B. The first soundproofing member 41 may be formed of a porous material, such as sponge.

The fourth exhaust passage D is provided at the upper side of the fan motor 3 and is connected to the left and right passages C-1 and C-2 of the third exhaust passage. Accordingly, the two air flows which are moved along the left and right passages C-1 and C-2 of the third exhaust passage are gathered at the fourth exhaust passage D and form a single air flow. The fourth exhaust passage D guides the air flow to the exhaust port 37 formed at the upper surface 30*f* of the fan motor casing 5. The exhaust port 37 is located at the upper side of the rear end portion of the fan motor 3. The fourth exhaust passage D is formed to be symmetrical with respect to the second exhaust passage B based on the fan motor 3. A second soundproofing member 42 may be installed in the fourth exhaust passage to reduce noise of the discharged air. The second soundproofing member 42 may be formed of a porous material, such as sponge.

The first exhaust passage A, second exhaust passage B, third exhaust passage C-1 and C-2 and fourth exhaust passage D described above may be formed in the fan motor casing 5 as a separate member from the fan motor 3. However, in the present example embodiment, the above-described exhaust passages A, B, C-1, C-2 and D are formed with the outer side surface of the fan motor 3 and the fan motor casing 5.

A fan motor 3 which forms an exhaust passage of the motor assembly 1 and a fan motor casing 5 will be described in detail below with reference to the accompanying drawings.

Referring to FIGS. 9, 10, 13 and 14, the fan motor 3 includes a motor unit 10 and a fan unit 20 installed at a front end of the motor unit 10.

Figure 13:
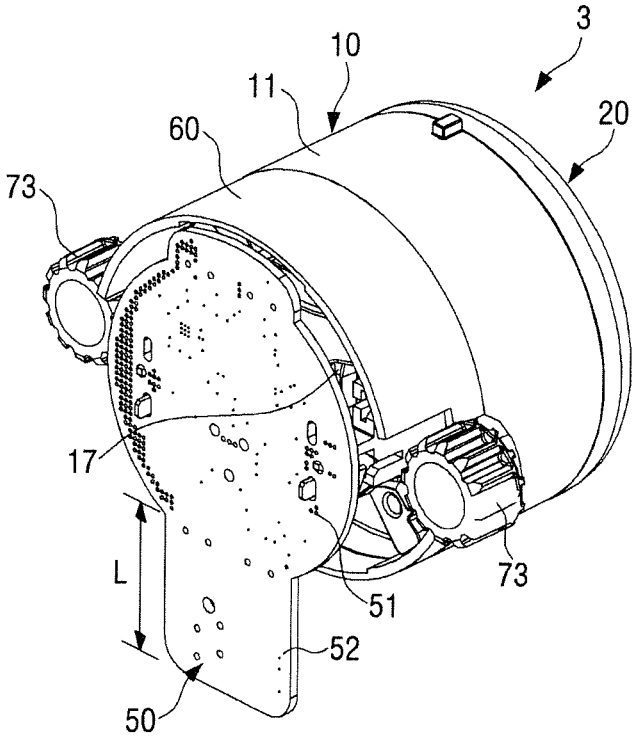
FIG. 13 is a rear perspective view of the fan motor of the motor assembly of FIG. 8.
Figure 14:
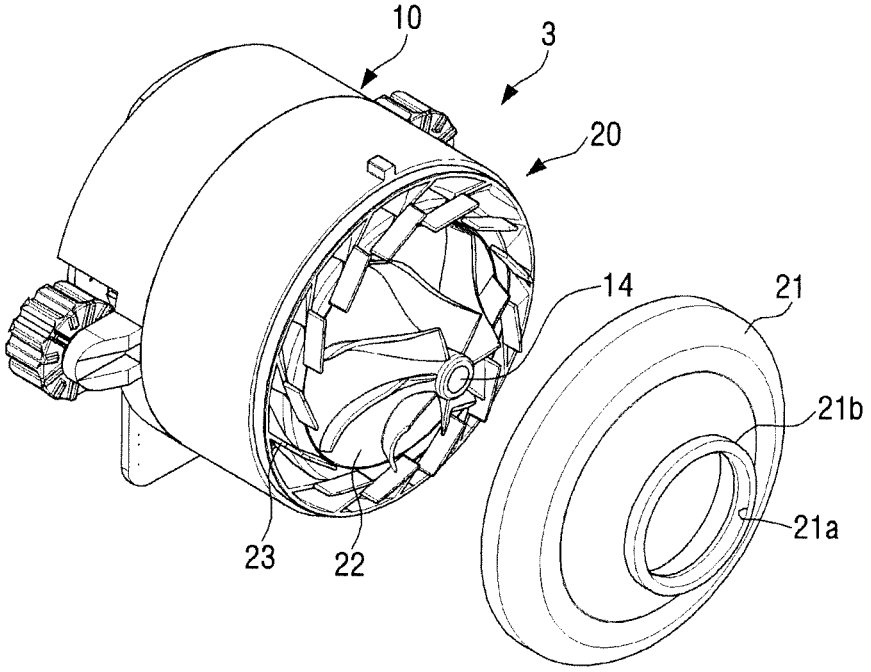
FIG. 14 is a perspective view illustrating a state in which a front cover is separated from the fan motor of the motor assembly of FIG. 8.

FIG. 13 is a rear perspective view of a fan motor of a motor assembly of FIG. 8. FIG. 14 is a perspective view illustrating a state in which a front cover is separated from the fan motor of the motor assembly of FIG. 8.

The motor unit 10 includes a housing 11, a stator 12, and a rotor 13. The stator 12 is installed on the interior side of the housing 11, and the rotor 13 is installed to be rotatable with respect to the stator 12 on the interior side of the stator 12. A rotation axis 14 of the rotor 13 is rotatably supported by a bearing 15 installed on the front and rear sides of the housing 11. On the rear side of the housing 11, an outlet 17 from which the air sucked via the fan unit 20 is discharged is provided. The motor unit 10 of the fan motor 3 may be implemented as a brushless DC (BLDC) motor.

Figure 15:
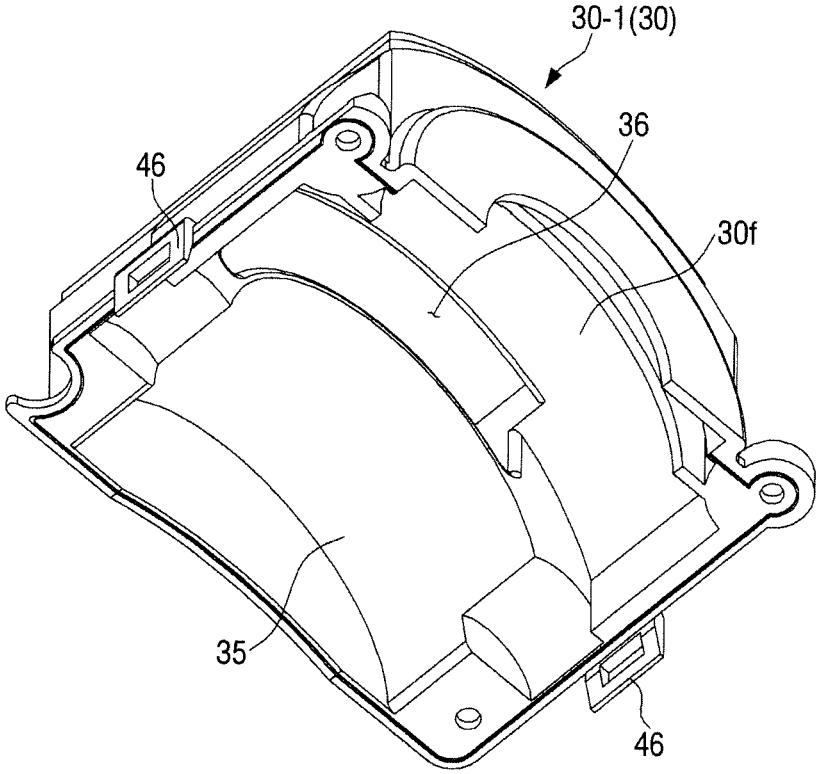
FIG. 15 is a bottom perspective view illustrating an upper case body of a fan motor casing of the motor assembly of FIGS. 8.

Referring to FIG. 15, the fan unit 20 is installed on the front end of the motor 10, and includes a front cover 20, an impeller 22, and a diffuser 23. The impeller 22 is fixed at one end of the rotation axis 14 of the rotor 13 of the motor unit 10, and is rotated integrally with the rotor 13. The diffuser 23 is fixed at a front surface of the housing 11 and on the same axis, the impeller 22 is rotatably installed therein. The diffuser 23 guides air sucked by the rotation of the impeller 22 to the motor unit 10. The front cover 21 is installed at one end of the housing 11, and is formed to cover the impeller 22 and the diffuser 23. In the center of the front cover 21, an intake port 21*a* through which the air is intake port into the impeller 22 is formed. Accordingly, when the impeller 22 is rotated by the rotor 13 of the motor unit 10, the outside air is intake port into the impeller 22 via the intake port 21*a* of the front cover 21, and is moved along an inner side of the housing 11 via the diffuser 23, and is discharged outside the fan motor 3 via the outlet 17 formed at a rear end of the motor unit 10.

At the rear end of the fan motor 3, that is, an end opposite to an end at which the fan unit 20 is installed, a printed circuit board 50 is installed to be spaced apart a predetermined distance from the rear surface of the fan motor 50. At the printed circuit board 50, a driving circuit capable of driving and controlling the fan motor 3 is provided. A shape of the printed circuit board 50 includes a circular part 51 of a circular cross section corresponding to a cross section of the fan motor 3 and a rectangular part 52 which is rectangularly extended from the circular part 51 to one side. A length (L) of the rectangular part 52 is determined such that one end of the rectangular part 52 is protruded to an outer side of the housing 11 of the fan motor 3. In the present example embodiment, as illustrated in FIG. 10, a length (L) of the rectangular part 52 of the printed circuit board 50 is determined such that an end of the rectangular part 52 is adjacent to a lower surface of the fan motor casing 5. In a case in which a buffer chamber 33 which will be described later is formed at a lower surface of the fan motor casing 5, a length (L) of the rectangular part 52 may be determined such that an end of the rectangular part 52 is located at the buffer chamber 33.

In addition, at a rear end of the fan motor 3, an extension part 60 which covers an upper portion of a space between the printed circuit board 50 and a rear surface of the fan motor 3 is installed. The extension part 60 is extended from a rear end of the housing 11 toward the printed circuit board 50. A length of the extension part 50 may be formed approximately half of a circumference of the housing 11. The extension part 50 is provided at the housing 11 opposite to the rectangular part 52 of the printed circuit board 50.

Accordingly, at the rear end of the fan motor 3, a first exhaust passage A which guides air discharged from the rear end of the fan motor 3 is formed by the extension part 60 and the printed circuit board 50.

The first exhaust passage A which is formed by the extension part 60 and the printed circuit board 50 serves to change a proceeding direction of the air discharged to the rear end of the fan motor 3 along an inner surface of the housing 11. As illustrated in FIGS. 10 and 13, the extension part 60 and the printed circuit board 50 bend a moving direction of air discharged from the rear end of the housing 11 approximately at right angles so that the discharged air is moved toward a lower direction of the fan motor 3. In the example embodiment illustrated in FIGS. 10 and 13, the extension part 60 and the printed circuit board 50 are formed to move air discharged from the rear end of the fan motor 3 toward a lower direction of the fan motor 3, but this is only an example. As another example, the extension part 60 and the printed circuit board 50 may be formed to change a moving direction of air discharged from the rear end of the fan motor 3 to any one side of the fan motor 3, such as an upper side, left side or right side of the fan motor 3.

Referring to FIGS. 8-10, the fan motor casing 5 is formed as a case body 30 in which a receiving unit capable of receiving the above-described fan motor 3 is provided. The case body 30 may be formed by an upper case body 30-1 and a lower case body 30-2 to assemble the fan motor 3. The upper case body 30-1 and the lower case body 30-2 may be removably coupled by a coupling member. Referring to FIGS. 8 and 9, in the present example embodiment, a pair of joint parts 46 in which a coupling hole 46*a* is formed are provided at opposite sides of the upper case body 30-1, and a pair of coupling projections 47 which are capable of being inserted into the coupling hole 46*a* of the pair of joint parts 46*a* are provided at the lower case body 30-2. Accordingly, when the pair of coupling projections 47 are inserted into the coupling hole 46*a* of the pair of joint parts 46, the upper case body 30-1 and the lower case body 30-2 are coupled with each other and form a single case body 30. In addition, a sealing member to prevent air leakage may be installed between the upper case body 30-1 and the lower case body 30-2.

An opening 30*a*-1 through which a front end 20*b* of a front cover 21 of the fan motor 3 is exposed outside is provided at a front surface of the case body 30. In the present example embodiment, a front vibration blocking member 71 to support the fan motor 3 with respect to the fan motor casing 5 is installed at the opening 30*a*-1 of the case body 30. The front vibration blocking member 71 is formed to absorb vibration of the fan motor 3 and block the vibration of the fan motor 3 from being transferred to the case body 30. The front vibration blocking member 71 has the shape of a ring. A front end 21*b* of the front cover 21 of the fan motor 3 is inserted into a hole 71*a* in the center. An outer circumference of the front vibration blocking member 71 is fixed to the opening 30*a*-1 of the case body 30. The front vibration blocking member 71 may be formed of a material that is capable of blocking vibration, such as rubber.

A pair of vertical walls 31 which are extended from left and right sides 30*c* and 30*d* toward a center of the case body 30 may be provided in the case body 30. When the fan motor 3 is received in the case body 30, the pair of vertical walls 31 divide the inner part of the case body 30 into a front chamber 32-1 and a rear chamber 32-2. In this regard, the front chamber 32-1 and the rear chamber 32-2 are interconnected via a space between a pair of vertical walls 31 below the fan motor 3. A buffer chamber 33 is provided on the lower surface of the case body 30 between the pair of vertical walls 31. The buffer chamber 33 may be formed as a concave groove of a predetermined depth from the lower surface 30*e* of the case body 30. Accordingly, some of air discharged via the exhaust port A provided at the rear end of the fan motor 3 may stay at the buffer chamber 33 and is moved to the front end of the fan motor 3.

In addition, the pair of vertical walls 31 is formed to be able to support the fan motor 3 with respect to the case body 30. In this regard, a rear vibration blocking member 73 may be installed between the fan motor 3 and the vertical wall 31 so as not to transfer vibration of the fan motor 3 to the case body 30. In the present example embodiment, two rear vibration blocking members 73 are installed so that they are symmetrical to the left and right sides of the fan motor 3, and the two rear vibration blocking members 73 may be supported by an upper end of the pair of vertical walls 31. The rear vibration blocking member 73 may be formed of a material that is capable of blocking vibration, such as rubber.

The fan motor 3 is installed in the case body 30 by the front vibration blocking member 71 installed at the front end and the rear vibration blocking member 73 installed at the rear side. Thus, when the fan motor 3 is rotated, the vibration of the fan motor 3 is not transferred to the case body 30.

As illustrated in FIGS. 8, 9, 10 and 15, a barrier 35 which is protruded into the case body 30 is provided at the rear end 30*b* of the case body 30 so that a rear end portion of the fan motor 3 is covered. The barrier 35 is installed at the upper side of the extension part 60 of the fan motor 3, covers an upper part of the rear chamber 32-2 of the case body 30, and blocks air discharged to the rear side of the fan motor 3 from being discharged to the upper side of the case body 30. FIG. 15 is a bottom perspective view of an upper case body 30-1 of the motor assembly 1 of FIG. 8.

An exhaust port 37 is provided toward the upper side of the barrier 35 on the upper surface 30*f* of the case body 30. Accordingly, the barrier 35 and the upper surface 30*f* of the case body 30 are spaced apart a predetermined distance from each other, and an opening 36 is formed therebetween. Accordingly, when the fan motor 3 is installed at the case body 30, a space between the upper surface of the fan motor 3 and the upper surface 30*f* of the case body 30 and the exhaust port 37 are interconnected via the opening 36.

Figure 16:
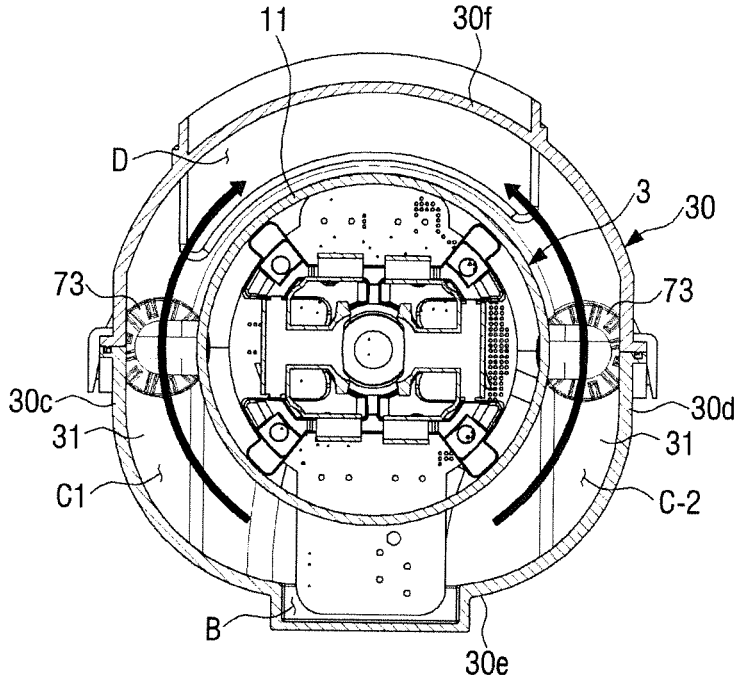
FIG. 16 is a cross-sectional view in which the motor assembly of FIG. 10 is cut along the line II-II.

In addition, when the fan motor 3 is installed at the case body 30, the left and right sides 30*c* and 30*d* of the case body 30 are formed such that the left and right sides of the fan motor 3 are spaced apart a predetermined distance from the left and right sides 30*c* and 30*d* of the case body 30. Accordingly, a left passage C-1 and right passage C-2 through which air may pass are formed between the left and right sides of the fan motor 3 and the left and right sides 30*c* and 30*d* of the case body 30 as illustrated in FIG. 16. FIG. 16 is a cross-sectional view in which the motor assembly 1 of FIG. 10 is cut along the line II-II.

A plurality of fixing parts 49 for fixing the case body 30 at an installation place are provided at an edge of the case body 30. For example, when the motor assembly 1 is used in the robot cleaner 100, a plurality of fixing parts 49 are provided in the case body 30 so that they correspond to a plurality of protrusions 123 provided at the base 120 of the robot cleaner 100. In the present example embodiment, four protrusions 123 are provided at the base 120 of the robot cleaner 100 and thus, four fixing parts 49 are provided at the case body 30. A hole 49*a* through which a coupling member, such as a nut and a bolt, is penetrated is provided at the fixing part 49.

In addition, the fan motor 3 and the fan motor casing 5 are connected to each other by only the front vibration blocking member 71 and the rear vibration blocking member 73. Other portions of the fan motor casing 5 are formed not to come in contact with the fan motor 3. Accordingly, a gap is present between the fan motor 3 and the case body 30 of the fan motor casing 5. Accordingly, if necessary, a vibration blocking member of an elastic material may be installed to prevent air from leaking from a gap between the fan motor 3 and the case body 30 and to block vibration.

The fan motor casing 5 having the structure described above forms an exhaust passage along with the fan motor 3. In detail, the rear surface 30*b* of the case body 30, the rear surface of the fan motor 3 and the barrier 35 of the case body form a first exhaust passage A which guides air discharged from the discharge port 17 of the fan motor 3 toward the lower direction of the fan motor 3. In this regard, the printed circuit board 50 and the extension part 60 are installed at the rear surface of the fan motor 3 and thus, most of air discharged to the rear surface of the fan motor 3 is moved below the fan motor 3 through a space between the printed circuit board 50, the extension part 60 and the rear surface of the fan motor 3. In this regard, the air discharged through a gap between the printed circuit board 50 and the fan motor 3 is moved to the lower direction of the fan motor 3 by the rear surface 30*b* of the case body 30 covering the exterior of the printed circuit board 50 and the barrier 35. Accordingly, the first exhaust passage A, in a narrow sense, is formed by the printed circuit board 50, the extension part 60 and the rear surface of the fan motor 3. The first exhaust passage, in a broad sense, is formed by the rear surface 30*b* of the case body 30, the barrier 35 and the rear surface of the fan motor 3.

The lower surface 30*e* of the case body 30 and the lower surface of the fan motor 3 form a second exhaust passage B guiding air discharged from the first exhaust passage A toward the front end of the fan motor 3.

The left and right sides 30*c* and 30*d* of the case body 30 and the left and right sides of the fan motor 3 fouls a third exhaust passage C-1 and C-2 which controls air discharged from the second exhaust passage B to be moved toward the upper side of the fan motor along the left and right sides of the fan motor 3. That is, the left side of the fan motor 3 and the left side 30*c* of the case body 30 form a left passage C-1 of the third exhaust passage, and the right side of the fan motor 3 and the right side of the case body 30 form a right passage C-2 of the third exhaust passage. Accordingly, the air which has moved to the front side of the fan motor 3 along the second exhaust passage B is diverged into two air flows by the third exhaust passage C-1 and C-2 and moved to the upper side of the fan motor 3.

The upper surface 30*f* of the case body 30, the upper surface of the fan motor 3, and the barrier 35 of the case body 30 form a fourth exhaust passage D which guides the air moved along the left and right passages C-1 and C-2 of the third exhaust passage to the discharge port 37. Accordingly, the two air flows which have moved to the upper side of the fan motor 3 along the left and right passages C-1 and C-2 of the third exhaust passage are joined as a single air flow by the fourth exhaust passage D and then, moved to the discharge port 37 formed on the upper surface 30*f* of the case body 30 and discharged outside the case body. In this regard, the fourth exhaust passage D is formed to be symmetrical to the second exhaust passage B with respect to a center axis of the fan motor 3.

In the motor assembly 1 according to an example embodiment having the structure described above, the air sucked through the intake port 20*a* installed at the front surface is discharged outside via the discharge port 37 provided at the upper surface of the fan motor casing 5 through the exhaust passages A, B, C-1, C-2 and D provided between the fan motor 3 and the fan motor casing 5. In detail, the air sucked by the intake port 20*a* of the fan motor 3 is discharged to the rear end of the fan motor 3 and then, moved toward a front end of the fan motor 3 along an outer circumference of the fan motor 3, moved from the front end part of the fan motor 3 toward the upper side of the fan motor 3 along the left and right sides of the fan motor 3, and then discharged from the discharge port 37 formed at the upper side of the rear end of the fan motor 3. Accordingly, the air discharged from the fan motor 3 is discharged outside via long exhaust passages A, B, C-1, C-2 and D formed around the fan motor 3 and thus, the noise generated by the fan motor 3 is reduced.

In addition, the air discharged from the discharge port 37 of the motor assembly 1 is discharged outside of the robot cleaner 100 via a plurality of holes 161 of the exhaust cover 160 provided at the main body 110 of the robot cleaner 100. Accordingly, the noise of the fan motor 3 emitted via the discharged air can be further reduced.

Hereinabove, the present disclosure is described in example embodiments. The terms used in one or more example embodiments of the present disclosure are just for the purpose of describing particular example embodiments and are not intended to limit the present disclosure. Various variations and modifications of the present disclosure are possible according to the description above. Therefore, unless being additionally mentioned, the present disclosure may be freely executed within a scope of the claims.

The invention claimed is:

1. A robot cleaner, comprising:

a motor assembly, including:

a fan motor to suction air through a fan intake port provided at a suction end of the fan motor and to discharge the air through a discharge port formed at a discharge end of the fan motor opposite to the suction end;

a printed circuit board being spaced apart from the discharge end of the fan motor;

an extension part configured to cover a portion of a space between the printed circuit board and the discharge end of the fan motor; and a fan motor casing encasing the motor assembly, and including:

an exhaust port, which is formed at an upper surface of the fan motor casing and located at an upper side of a rear end portion of the fan motor, and an exhaust passage to guide, to the exhaust port, the air discharged from the fan motor, the exhaust passage of the fan motor casing including:

a first exhaust passage formed at the discharge end of the fan motor, to guide the air such that the air, discharged from the discharge port of the fan motor, moves in a first radial direction of the fan motor to a lower side of the fan motor;

a second exhaust passage formed at the lower side of the fan motor, to guide the air such that the air, discharged from the first exhaust passage, moves in an axial direction of the fan motor from the discharge end of the fan motor toward the suction end of the fan motor;

a third exhaust passage formed around the fan motor, to guide the air such that the air, discharged from the second exhaust passage, moves in a circumferential direction of the fan motor from the lower side of the fan motor to the upper side of the fan motor; and a fourth exhaust passage formed at the upper side of the fan motor, to guide the air such that the air, discharged from the third exhaust passage, moves along the upper side of the fan motor in the axial direction of the fan motor from the suction end of the fan motor toward the discharge end of the fan motor and then in a second radial direction of the fan motor, opposite of the first radial direction of the fan motor, from the upper side of the fan motor to the exhaust port of the fan motor casing on the upper side of the fan motor, wherein the first exhaust passage is formed by the printed circuit board, the extension part, and the discharge end of the fan motor.

2. The robot cleaner as claimed in claim 1, wherein the fan motor casing comprises:

a case body in which a receiving unit to receive the fan motor is provided;

a pair of vertical walls formed on left and right sides of the fan motor in the case body, and when the fan motor is received in the case body, dividing an inner part of the case body into a front chamber and a rear chamber; and a barrier provided adjacent to and above an upper side of a discharge end part of the fan motor and covering an upper side of the rear chamber.

3. The robot cleaner as claimed in claim 2, wherein the second exhaust passage is formed by a lower surface of the case body and a lower surface of the fan motor.

4. The robot cleaner as claimed in claim 3, wherein a soundproofing member is installed at the second exhaust passage.

5. The robot cleaner as claimed in claim 2, wherein the third exhaust passage is formed by left and right sides of the case body and left and right sides of the fan motor.

6. The robot cleaner as claimed in claim 2, wherein the fourth exhaust passage is formed by an upper surface of the case body, an upper surface of the fan motor, and the barrier of the case body.

7. The robot cleaner as claimed in claim 6, wherein a soundproofing member is installed at the fourth exhaust passage.

8. The robot cleaner as claimed in claim 2, wherein the fan motor casing includes an upper case body and a lower case body.

9. The robot cleaner as claimed in claim 1, further comprising:

a front vibration blocking member installed between the suction end of the fan motor and the fan motor casing; and a rear vibration blocking member installed between the discharge end of the fan motor and the fan motor casing.

10. The robot cleaner as claimed in claim 1, further comprising:

a cleaner body in which a motor receiving unit in which the motor assembly is received is provided, wherein the cleaner body includes an exhaust cover to cover the discharge port of the motor assembly.

11. The robot cleaner as claimed in claim 10, wherein a plurality of protrusions are provided in the motor receiving unit of the cleaner body, and wherein a plurality of fixing parts corresponding to the plurality of protrusions are provided at the fan motor casing.

12. The robot cleaner as claimed in claim 10, wherein in the exhaust cover, a plurality of holes are formed at a portion corresponding to the discharge port of the motor assembly.

13. A robot cleaner, comprising:

a motor assembly, including:

a fan motor to suction air through a fan intake port provided at a front surface of the fan motor and to discharge the air through a discharge port formed at a rear surface of the fan motor;

a printed circuit board being spaced apart from the rear surface of the fan motor;

an extension part configured to cover a portion of a space between the printed circuit board and the rear surface of the fan motor; and a fan motor casing encasing the motor assembly, and including:

an exhaust port formed at an upper surface of the fan motor casing and located at an upper side of a rear end portion of the fan motor, the exhaust port being provided nearer to the discharge port than to the fan intake port;

an exhaust passage to guide the air discharged from the fan motor to the exhaust port, and the exhaust passage including a portion formed at the rear surface of the fan motor to guide air discharged from the discharge port in a first radial direction of the fan motor to a lower side of the fan motor, the portion of the exhaust passage formed by the printed circuit board, the extension part, and the rear surface of the fan motor;

a case body inside which a receiving unit to receive the fan motor is provided;

an air suctioning port formed at a front surface of the case body;

a pair of vertical walls formed to extend from left and right sides of the case body toward the fan motor, and when the fan motor is received in the case body, dividing an inner part of the case body into a front chamber and a rear chamber; and a barrier, provided adjacent to and above an upper side of the rear end portion of the fan motor, to cover an upper part of the rear chamber, the barrier and upper side of the fan motor partially forming another portion of the exhaust passage to guide air in a second radial direction of the fan motor, opposite of the first radial direction, to the exhaust port, wherein the exhaust port is formed at an upper side of the barrier.

14. The robot cleaner as claimed in claim 13, wherein the exhaust passage is formed at least partially by an outer side of the fan motor and the fan motor casing.

* * * * *